US007252094B2

(12) United States Patent
Maynard

(10) Patent No.: US 7,252,094 B2
(45) Date of Patent: Aug. 7, 2007

(54) SIDEBURN SHAVING GUIDE

(75) Inventor: David Arvin Maynard, Hollister, CA (US)

(73) Assignee: David Maynaro, Hollister, CA (US)

( * ) Notice: Subject to any disclaimer, the term of this patent is extended or adjusted under 35 U.S.C. 154(b) by 355 days.

(21) Appl. No.: 10/835,509

(22) Filed: Apr. 29, 2004

(65) Prior Publication Data

US 2004/0237988 A1 Dec. 2, 2004

Related U.S. Application Data

(60) Provisional application No. 60/466,814, filed on Apr. 29, 2003.

(51) Int. Cl.
*A45D 24/36* (2006.01)

(52) U.S. Cl. ..... 132/214

(58) Field of Classification Search ..... 132/213, 132/213.1, 214; 33/511, 512; 434/94
See application file for complete search history.

(56) References Cited

U.S. PATENT DOCUMENTS

| | | | | | |
|---|---|---|---|---|---|
| 1,504,436 | A | * | 8/1924 | Daughley | 132/214 |
| 2,749,922 | A | * | 6/1956 | Daniel et al. | 132/214 |
| 3,491,450 | A | * | 1/1970 | Ayoub | 33/512 |
| 3,613,694 | A | * | 10/1971 | Benjamin | 132/145 |
| 3,709,234 | A | * | 1/1973 | Seerahn | 132/214 |
| D251,898 | S | * | 5/1979 | Winston | D10/64 |
| 4,619,280 | A | * | 10/1986 | Yampolskaya | 132/214 |

* cited by examiner

*Primary Examiner*—Todd E. Manahan

(57) ABSTRACT

A basic yet effective right and left two-piece sideburn shaving guide invention, comprised of adhesive paper light in tack yet strong enough to work on users face without pulling out hair. Element 1 is the grid with fifty-four different positions used adjacent with users outside corner eyelid. Element 2 is the base of invention parallel with grid for easy and fast application positioning of the sideburn design. Element 3 is a shaving guide. Right and left shaving guide pieces are mirror images of one another.

1 Claim, 4 Drawing Sheets

SIDEBURN SHAVING GUIDE

CROSS REFERENCE TO RELATED APPLICATIONS

Applicant claims the benefit of earlier U.S. Provisional Application 60/466,814 filed Apr. 29, 2003.

BACKGROUND OF THE INVENTION

For the past fifteen years I have created uniquely styled sideburns for myself that have received many compliments. There were times though that no matter how long or hard I tried I could not reduplicate some of these unique sideburn designs. This and wanting to share with others was my main inspiration for inventing Styleburns. A shaving guideline invention that easily and quickly enables anyone regardless of ones individual size or shape face easy and fast attainability to shaving identically matched unique sideburns.

U.S. Pat. No. 4,010,764 issued to Wagner; Stan on Mar. 8, 1977 uses clamps, plates and attachments that is to be placed over the top portion of the user's head, the free ends of the band element of this invention falls adjacent to the user's sideburns. The ears are used as the reference mark to adjust proper positioning.

U.S. Pat. No. 2,786,477 issued to Jacob Cohen on Mar. 26, 1957 reveals the object of this invention is to provide a strap pivotally mounted on the U-shaped member in a shaving method that uses the flexible band firmly placed over the user's head comprising a bubble type level. The U-shaped member of this invention is made of spring steel material. This invention is mentioned to be secured by glue rivets at the top or the bight of the U-shaped member equidistant from the terminal ends.

U.S. Pat. No. 1,812,443 issued to Fred Mason on Jun. 30, 1931 This invention comprises a band of flexible material and indicates screws be attached to the end of flexible band. This invention is to be temporarily placed on the head and having at one end an adjustable gauge or guide, which enables the shaver to cut the edge of the hair in front of the ears in a straight line. A small sliding steel rod is used in this invention and is to be inserted selectively in said holes and protruding to rest upon the upper junction of either ear and the head.

The present invention is the only sideburn guide invention requiring no clamping, attachments or band elements, thus enabling the present invention to be applied much faster and without the hassle of clamping or applying attachments. With the present invention one can store in a smaller space and travel with much easier. Another distinct difference between my invention and U.S. Pat No. 4,010,764 U.S. Pat. No. 2,786,477 and U.S. Pat. No. 1,812,443 is my invention uses the corner outside eyelid as the distinct reference mark rather than the ear like the other sideburn guide inventions mentioned.

BRIEF SUMMARY OF THE INVENTION

The present invention is a right and left two-piece sideburn shaving guide. Both pieces mirror images of each other consisting of fifty-four positioning grid lines that's function is to be aligned parallel to ones outside corner eyelid, thus allowing the user to quickly match the desired grid to best fit his size and shape face. Once user finds desired fitting he simply peels adhesive paper off of invention remembering where his desired grid line was, then applies the invention to his face using the desired grid line as reference to his outside corner eyelid. The adhesive paper easily conforms to users face regardless of his size or shape. The present inventions simplicity using adhesive paper (which easily conforms to users face regardless of size and shape.) Rather than bands, clamps, plates and attachments and the present inventions precise reference point, (reference point revering to corner outside eyelid), is what clearly separates it from U.S. Pat. No 4,010,764, U.S. Pat. No. 2,786,477 and U.S. Pat. No. 1,812,443

DETAILED DESCRIPTION OF THE INVENTION

Figure 1:
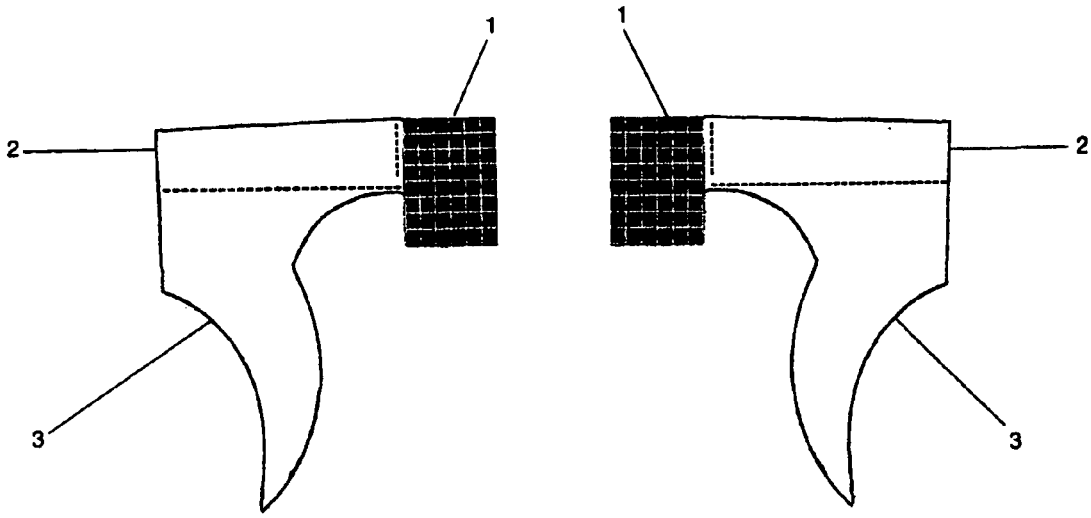
FIG. 1 shows the sideburn shaving guide of the instant invention with the two parts being mirror images of each other.
Figure 2:
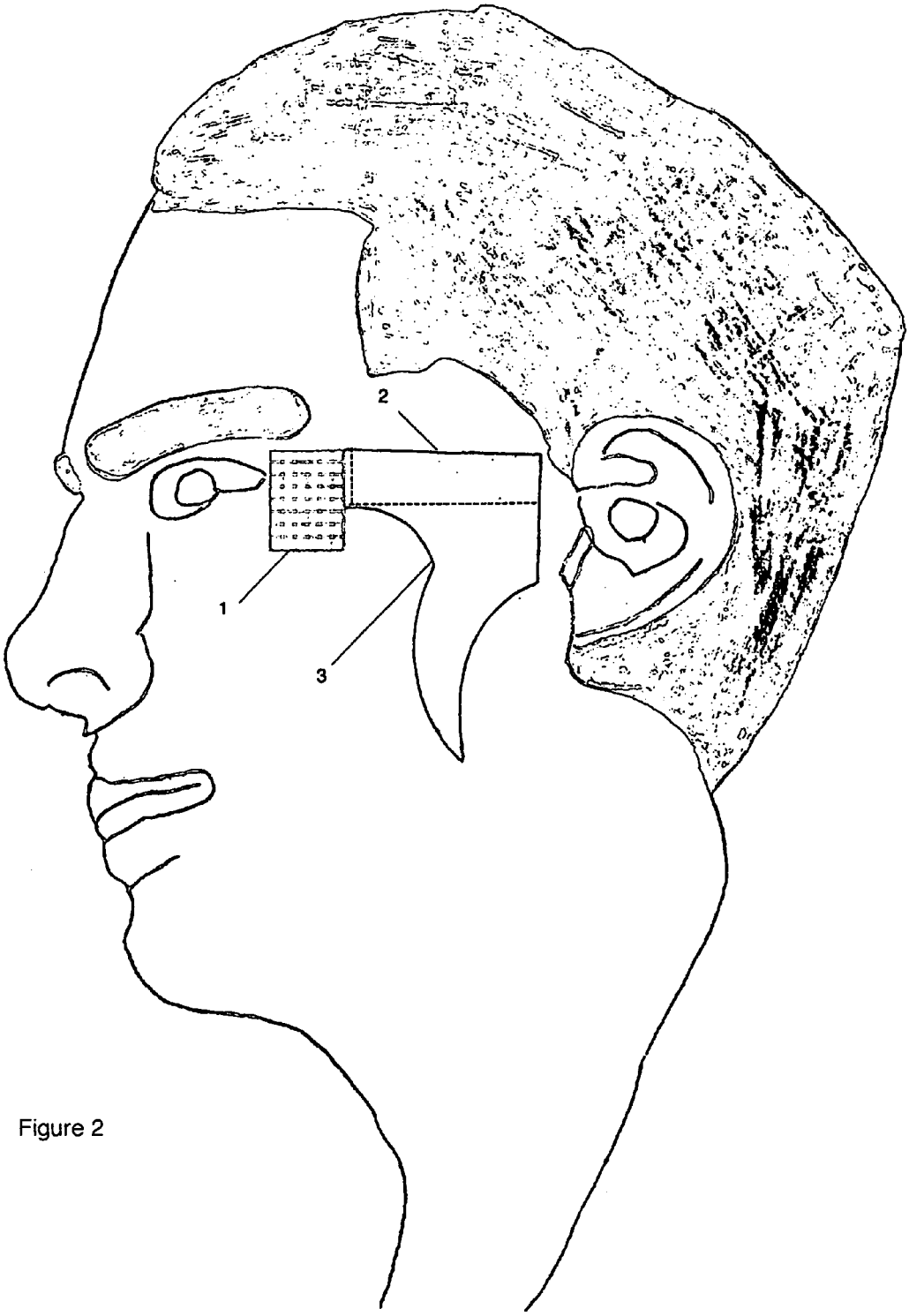
FIGS. 2 and 3 show the sideburn shaving guide in use with the gird element positioned in alignment with the corner outside eyelid.
Figure 3:
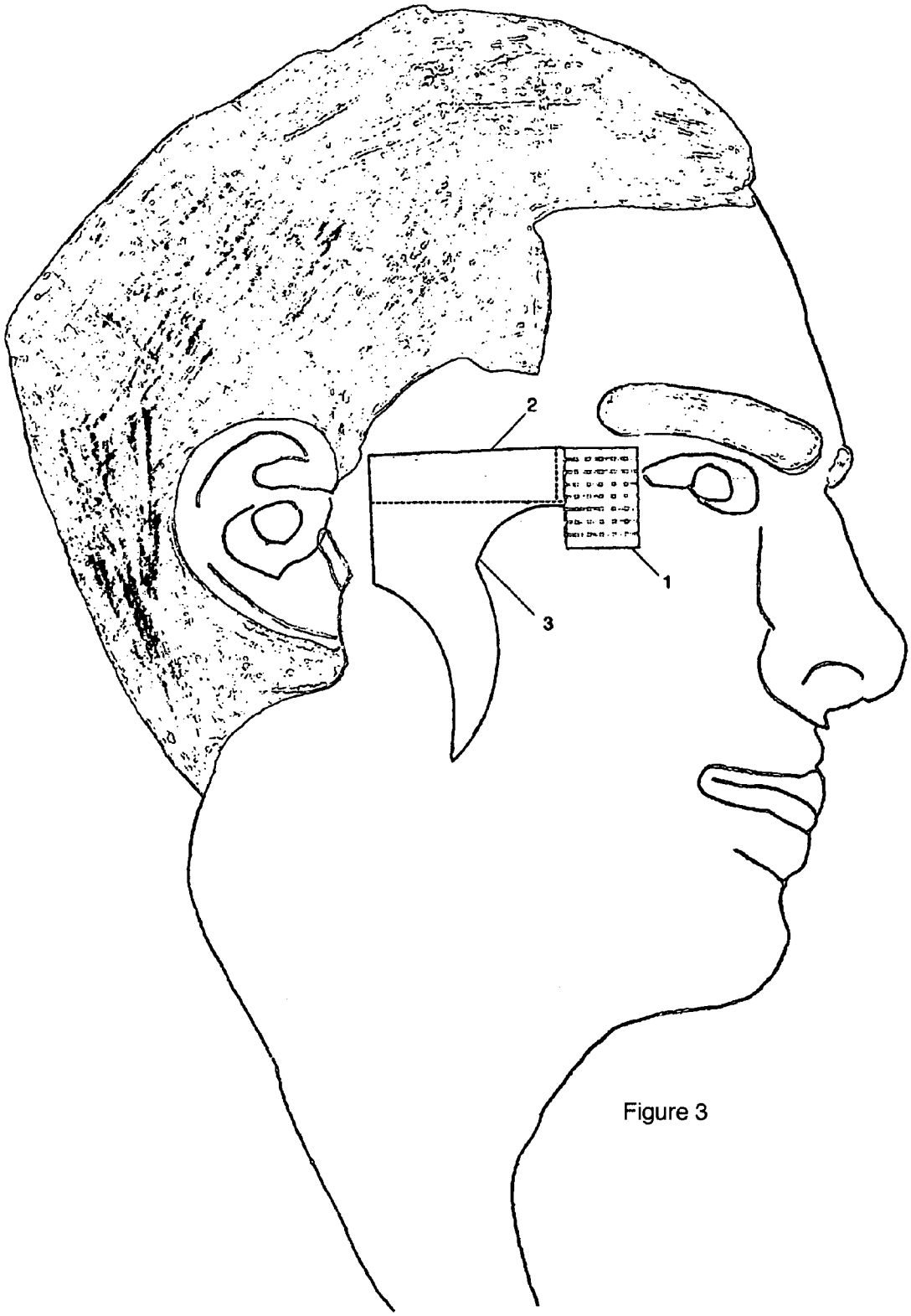
Figure 4:
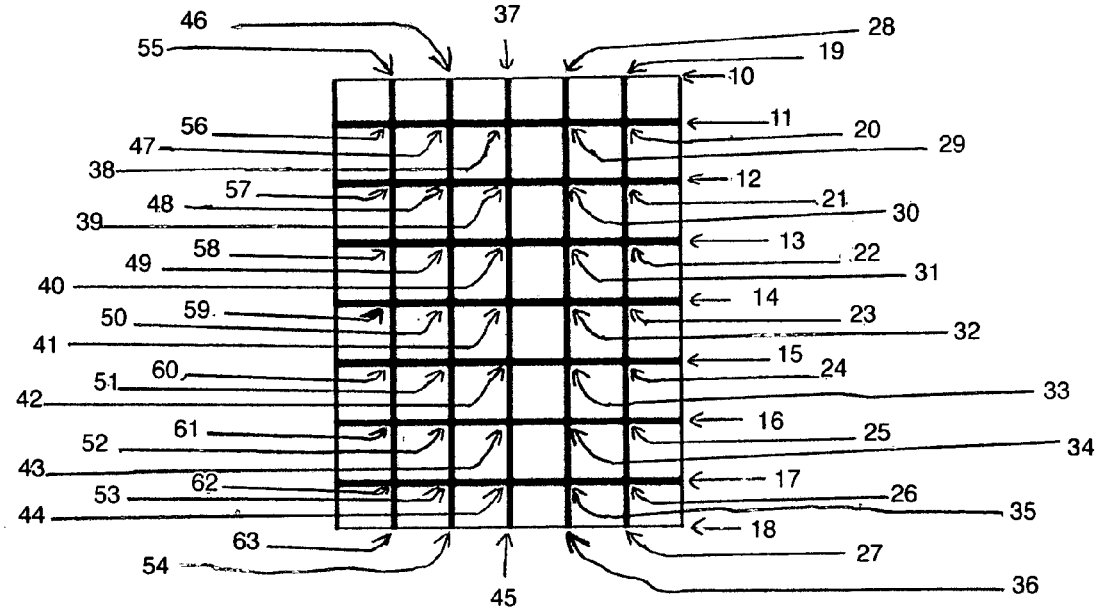
FIG. 4 is an enlarged view of the gird element of the sideburn shaving guide.

My invention is comprised out of adhesive paper light in tack yet strong enough to work on users face without pulling out users hair. Most of the detailed emphasis of my two-piece invention is on grid element 1 as seen in drawings on pgs. 1, 2, 3 and on page 4 grid element is depicted by itself enlarged with each of the fifty-four positions explained in great detail. Grid element 1 is the positioning guide of the invention and is the most important element of my invention. I will now list the fifty-four different positions on element 1 beginning with the first. The first positioning being number 10.

(10) Parallel aligned next to outside corner eyelid is the first positioning of my invention. Positions 19, 28,37,46,55 are adjacent with 10.

(11) Parallel aligned next to outside corner eyelid is the second positioning of invention. Positions 20,29,38,47,56 are adjacent with 11. Note: Elements 1,2,3 becomes slightly elevated towards top of skull.

(12) Parallel aligned next to outside corner eyelid is the third positioning of invention. Positions 21,30,39,48,57 are adjacent with 12. Note: Elements 1,2,3 becomes slightly more elevated towards top of skull than with second positioning.

(13) Parallel aligned next to outside corner eyelid is the fourth positioning of invention. Positions 22,31,40,49,58 are adjacent with 13. Note: Elements 1,2,3 becomes slightly more elevated towards top of skull than with third positioning.

(14) Parallel aligned next to outside corner eyelid is the fifth positioning of invention. Positions 23,32,41,50,59 are adjacent with 14. Note: Elements 1,2,3 becomes slightly more elevated towards top of skull than with fourth positioning.

(15) Parallel aligned next to outside corner eyelid is the six positioning of invention. Positions 24,33,42,51,60 are adjacent with 15. Note: Elements 1,2,3 becomes slightly more elevated towards top of skull than with fifth positioning.

(16) Parallel aligned next to outside corner eyelid is the seventh positioning of invention. Positions 25,34,43,52,61 are adjacent with 16. Note: Elements 1,2,3 becomes slightly more elevated towards top of skull than with sixth positioning.

(17) Parallel aligned next to outside corner eyelid is the eighth positioning of invention. Positions 26,35,44,53,62 are adjacent with 17. Note: Elements 1,2,3 becomes slightly more elevated towards top of skull than with seventh positioning.

(18) Parallel aligned next to outside corner eyelid is the ninth positioning of invention. Positions 27,36,45,54,63 are adjacent with 18. Note: Elements 1,2,3 becomes slightly more elevated towards top of skull than with eighth positioning thus elevating to the fullest degree of the invention.

(19) Parallel aligned next to outside corner eyelid is the tenth positioning of invention Positions 10, 28, 37, 46, 54 are adjacent with 19. Note: Elements 1,2,3 in the tenth position is in the lowest elevation degree of the invention. For one to achieve tenth positioning of invention, the first nine positioning grids 10 through 18 must be cut out before applying.

(20) Parallel aligned next to outside corner eyelid is the eleventh positioning of invention. Positions 11, 29, 38, 47, 56 are adjacent with 20. Note: Elements 1,2,3 becomes slightly elevated towards top of skull. For one to achieve eleventh positioning, the first nine positioning grids, 10 through 18 must be cut out before applying.

(21) Parallel aligned next to outside corner eyelid is the twelve positioning of invention. Positions 12, 30, 39, 48, 57 are adjacent with 21. Note: Elements 1,2,3 becomes slightly more elevated towards top of skull than with eleventh positioning. For one to achieve twelve positioning, the first through ninth positioning grids, 10 through 18 must be cut out before applying.

(22) Parallel aligned next to outside corner eyelid is the thirteenth positioning of invention. Positions 13, 31, 40, 49, 58 are adjacent with 22. Note: Elements 1,2,3 becomes slightly more elevated towards top of skull than with twelve positioning. For one to achieve thirteenth positioning, 10 through 18 positioning grids must be cut out before applying.

(23) Parallel aligned next to outside corner eyelid is the fourteenth positioning of invention. Positions 1432415059 are adjacent with 23. Note: Elements 1,2,3 becomes slightly more elevated towards top of skull than with thirteenth positioning. For one to achieve fourteenth positioning, 10 through 18 positioning grids must be cut out before applying.

(24) Parallel aligned next to outside corner eyelid is the fifteenth positioning of invention. Positions 1533425160 are adjacent with 24. Note: Elements 1,2,3 becomes slightly more elevated towards top of skull than with fourteenth positioning. For one to achieve fifteenth positioning, 10 through 18 positioning grids must be cut out before applying.

(25) Parallel aligned next to outside corner eyelid is the sixteenth positioning of invention. Positions 1634435261 are adjacent with 25. Note: Elements 1,2,3 becomes slightly more elevated towards top of skull than with fifteenth positioning. For one to achieve sixteenth positioning, 10 through 18 positioning grids must be cut out before applying.

(26) Parallel aligned next to outside corner eyelid is the seventeenth positioning of invention. Positions 17, 35, 44, 53, 62 are adjacent with 26. Note: Elements 1,2,3 becomes slightly more elevated towards top of skull than with sixteenth positioning. For one to achieve seventeenth positioning, 10 through 18 positioning grids must be cut out before applying.

(27) Parallel aligned next to outside corner eyelid is the eighteenth positioning of invention. Positions 18, 36, 45, 54, 63 are adjacent with 27. Note: Elements 1,2,3 becomes slightly more elevated towards top of skull than with seventeenth positioning, thus elevating to the fullest degree of invention for one to achieve eighteenth positioning, 10 through 18 positioning grids must be cut out before applying.

(28) Parallel aligned next to outside corner eyelid is the nineteenth positioning of invention. Positions 10, 19, 37, 46, 55 are adjacent with 28 Note: Elements 1,2,3 in the nineteenth position 28 is in the lowest elevation degree of invention. For one to achieve nineteenth positioning, the first eighteen 10 through 27 positioning grids must be cut out before applying.

(29) Parallel aligned next to outside corner eyelid is the twentieth positioning of invention. Positions 11, 20, 38, 47, 56 are adjacent with 29 Note: Elements 1,2,3 becomes slightly elevated towards top of skull. For one to achieve twentieth positioning, 10, through 27 positioning grids must be cut out before applying.

(30) Parallel aligned next to outside corner eyelid is the twenty-first positioning of invention. Positions 12, 21, 39, 48, 57 are adjacent with 30 Note: Elements 1,2,3 becomes slightly more elevated towards top of skull than with twentieth positioning. For one to achieve twenty-first positioning, 10, through 27, positioning grids must be cut out before applying.

(31) Parallel aligned next to outside corner eyelid is the twenty-second positioning of invention. Positions 13, 22,40, 49, 58 are adjacent with 31 Note: Elements 1,2,3 becomes slightly more elevated towards top of skull than with twenty-first positioning. For one to achieve twenty-second positioning 10 through 27 positioning grids must be cut out before applying invention.

(32) Parallel aligned next to outside corner eyelid is the twenty-third positioning of invention. Positions 14, 23, 41, 50, 59 are adjacent with 32 Note: Elements 1,2,3 becomes slightly more elevated towards top of skull than with twenty-second positioning. For one to achieve twenty-third positioning 10 through 27 positioning grids must be cut out before applying invention.

(33) Parallel aligned next to outside corner eyelid is the twenty-fourth positioning of invention. Positions 15, 24, 42, 51, 60 are adjacent with 33 Note: Elements 1,2,3 becomes slightly more elevated towards top of skull than with twenty-third positioning. For one to achieve twenty-fourth positioning 10 through 27 positioning grids must be cut out before applying invention.

(34) Parallel aligned next to outside corner eyelid is the twenty-fifth positioning of invention. Positions 16, 25, 43, 52, 61 are adjacent with 34 Note: Elements 1,2,3 becomes slightly more elevated towards top of skull than with twenty-fourth positioning. For one to achieve twenty-fifth positioning, 10 through 27 positioning grids must be cut out before applying invention.

(35) Parallel aligned next to outside corner eyelid is the twenty-six positioning of invention. Positions 17, 26, 44, 53, 62 are adjacent with 35 Note: Elements 1,2,3 becomes slightly more elevated towards top of skull than with twenty-fifth positioning. For one to achieve twenty-six positioning, 10 through 27 positioning grids must be cut out before applying invention.

(36) Parallel aligned next to outside corner eyelid is the twenty-seventh positioning of invention. Positions 18, 27, 45, 54, 63 are adjacent with 36 Note: Elements 1,2,3 becomes slightly more elevated towards top of skull than with twenty-sixth positioning, thus elevating invention to the furthest degree. For one to achieve twenty-seventh positioning, 10 through 27 positioning grids must be cut out before applying invention.

(37) Parallel aligned next to outside corner eyelid is the twenty-eighth positioning of invention. Positions 10, 19, 28, 46, 55 are adjacent with 37 Note: Elements 1,2,3 in the twenty-eighth position, is in the lowest elevation degree of the invention. For one to achieve twenty-eighth positioning, the first thirty-six, 10 through 45 positioning grids must be cut out before applying invention.

(38) Parallel aligned next to outside corner eyelid is the twenty-ninth positioning of invention. Positions 11, 20, 29, 47, 56 are adjacent with 38. Note: Elements 1,2,3 becomes slightly elevated towards top of skull. For one to achieve twenty-ninth positioning, 10 through 45 positioning grids must be cut out before applying invention.

(39) Parallel aligned next to outside corner eyelid is the thirtieth positioning of invention. Positions 12, 21, 30, 48, 57 are adjacent with 39. Note: Elements 1,2,3 becomes slightly more elevated towards top of skull than twenty-ninth positioning. For one to achieve thirtieth positioning, 10 through 45 positioning grids must be cut out before applying invention.

(40) Parallel aligned next to outside corner eyelid is the thirty-first positioning of invention. Positions 13, 22, 31, 49, 58 are adjacent with 40. Note: Elements 1,2,3 becomes slightly more elevated towards top of skull than thirtieth positioning. For one to achieve thirty-first positioning 10 through 45 positioning grids must be cut out before applying invention.

(41) Parallel aligned next to outside corner eyelid is the thirty-second positioning of invention. Positions 14, 23, 32, 50, 59 are adjacent with 41. Note: Elements 1,2,3 becomes slightly more elevated towards top of skull than thirty-first positioning. For one to achieve thirty-second positioning 10 through 45 positioning grids must be cut out before applying invention.

(42) Parallel aligned next to outside corner eyelid is the thirty-third positioning of invention. Positions 15, 24, 33, 51, 60 are adjacent with 42. Note: Elements 1,2,3 becomes slightly more elevated towards top of skull than thirty-second positioning. For one to achieve thirty-third positioning 10 through 45 positioning grids must be cut out before applying invention.

(43) Parallel aligned next to outside corner eyelid is the thirty-fourth positioning of invention. Positions 16, 25, 34, 52, 61 are adjacent with 43. Note: Elements 1,2,3 becomes slightly more elevated towards top of skull than thirty-third positioning. For one to achieve thirty-fourth positioning 10 through 45 positioning grids must be cut out before applying invention.

(44) Parallel aligned next to outside corner eyelid is the thirty-fifth positioning of invention. Positions 17, 26, 35, 53, 62 are adjacent with 44. Note: Elements 1,2,3 becomes slightly more elevated towards top of skull than thirty-fourth positioning. For one to achieve thirty-fifth positioning 10 through 45 positioning grids must be cut out before applying invention.

(45) Parallel aligned next to outside corner eyelid is the thirty-sixth positioning of invention. Positions 18, 27, 36, 54, 63 are adjacent with 45. Note: Elements 1,2,3 becomes slightly more elevated towards top of skull than thirty-fifth positioning, thus elevating to the furthest degree of invention. For one to achieve thirty-sixth positioning, 10 through 45 positioning grids must be cut out before applying invention.

(46) Parallel aligned next to outside corner eyelid is the thirty-seventh positioning of invention. Positions 10, 19, 28, 37, 55 are adjacent with 46. Note: Elements 1,2,3 in the thirty-seventh position, is the lowest elevation degree of the invention. For one to achieve thirty-seventh positioning, the first forty-five, 10 through 54 positioning grids must be cut out before applying invention.

(47) Parallel aligned next to outside corner eyelid is the thirty-eighth positioning of invention. Positions 11, 20, 29, 38, 56 are adjacent with 47. Note: Elements 1,2,3 in the thirty-eighth positioning is slightly elevated towards top of skull. For one to achieve thirty-eighth positioning, 10 through 54 positioning grids must be cut out before applying invention.

(48) Parallel aligned next to outside corner eyelid is the thirty-ninth positioning of invention. Positions 12, 21, 30, 39, 57 are adjacent with 48. Note: Elements 1,2,3 becomes slightly more elevated towards top of skull than thirty-eighth positioning. For one to achieve thirty-ninth positioning, 10 Through 54 positioning grids must be cut out before applying invention.

(49) Parallel aligned next to outside corner eyelid is the fortieth positioning of invention. Positions 13, 22, 31, 40, 58 are adjacent with 49. Note: Elements 1,2,3 becomes slightly more elevated towards top of skull than thirty-ninth positioning. For one to achieve fortieth positioning, 10 through 54 positioning grids must be cut out before applying invention.

(50) Parallel aligned next to outside corner eyelid is the forty-first positioning of invention. Positions 14, 23, 32, 41, 59 are adjacent with 50. Note: Elements 1,2,3 becomes slightly more elevated towards top of skull than fortieth positioning. For one to achieve forty-first positioning, 10 through 54 positioning grids must be cut out before applying invention.

(51) Parallel aligned next to outside corner eyelid is the forty-second positioning of invention. Positions 15, 24, 33, 42, 60 are adjacent with 51. Note: Elements 1,2,3 becomes slightly more elevated towards top of skull than forty-first positioning. For one to achieve forty-second positioning, 10 through 54 positioning grids must be cut out before applying invention.

(52) Parallel aligned next to outside corner eyelid is the forty-third positioning of invention. Positions 16, 25, 34, 43, 61 are adjacent with 52. Note: Elements 1,2,3 becomes slightly more elevated towards top of skull than forty-second positioning. For one to achieve forty-third positioning, 10 through 54 positioning grids must be cut out before applying invention.

(53) Parallel aligned next to outside corner eyelid is the forty-fourth positioning of invention. Positions 17, 26, 35, 44, 62 are adjacent with 53. Note: Elements 1,2,3 becomes slightly more elevated towards top of skull than forty-third positioning. For one to achieve forty-fourth positioning, 10 through 54 positioning grids must be cut out before applying invention.

(54) Parallel aligned next to outside corner eyelid is the forty-fifth positioning of invention. Positions 18, 27, 36, 45, 63 are adjacent with 54. Note: Elements 1,2,3 becomes slightly more elevated towards top of skull than forty-fourth positioning, thus elevating to the fullest degree of invention. For one to achieve forty-fifth positioning, 10 through 54 positioning grids must be cut out before applying invention.

(55) Parallel aligned next to outside corner eyelid is the forty-sixth positioning of invention. Positions 10, 19, 28, 37, 46 are adjacent with 55. Note: Elements 1,2,3 in the forty-sixth position is in the lowest elevation degree of the invention. For one to achieve forty-sixth positioning the first forty-five positions, 10 through 54 positioning grids must be cut out before applying invention.

(56) Parallel aligned next to outside corner eyelid is the forty-seventh positioning of invention. Positions 11, 20, 29, 38, 47 are adjacent with 56. Note: Elements 1,2,3 becomes slightly elevated towards top of skull. For one to achieve forty-seventh positioning, 10 through 54 positioning grids must be cut out before applying invention.

(57) Parallel aligned next to outside corner eyelid is the forty-eighth positioning of invention. Positions 12, 21, 30, 39, 48 are adjacent with 57. Note: Elements 1,2,3 becomes slightly more elevated towards top of skull than forty-seventh positioning. For one to achieve forty-eighth positioning, 10 through 54 positioning grids must to be cut out before applying invention.

(58) Parallel aligned next to outside corner eyelid is the forty-ninth positioning of invention. Positions 13, 22, 31, 40, 49 are adjacent with 58. Note: Elements 1,2,3 becomes slightly more elevated towards top of skull than in the forty-eighth position. For one to achieve forty-ninth positioning, 10 through 54 positioning grids must be cut out before applying invention.

(59) Parallel aligned next to outside corner eyelid is the fiftieth positioning of invention. Positions 14, 23, 32, 41, 50 are adjacent with 59. Note: Elements 1,2,3 becomes slightly more elevated towards top of skull than in the forty-ninth position. For one to achieve fiftieth positioning, 10 through 54 positioning grids must be cut out before applying invention.

(60) Parallel aligned next to outside corner eyelid is the fifty-first positioning of invention. Positions 15, 24, 33, 42, 51 are adjacent with 60. Note: Elements 1,2,3 becomes slightly more elevated towards top of skull than in the fiftieth position. For one to achieve fifty-first positioning, 10 through 54 positioning grids must be cut out before applying invention.

(61) Parallel aligned next to outside corner eyelid is the fifty-second positioning of invention. Positions 16, 25, 34, 43, 52 are adjacent with 61. Note: Elements 1,2,3 becomes slightly more elevated towards top of skull than in the fifty-first position. For one to achieve fifty-second positioning, 10 through 54 positioning grids must be cut out before applying invention.

(62) Parallel aligned next to outside corner eyelid is the fifty-third positioning of invention. Positions 17, 26, 35, 44, 53 are adjacent with 62. Note: Elements 1,2,3 becomes slightly more elevated towards top of skull than in the fifty-second position. For one to achieve fifty-third positioning, 10 through 54 positioning grids must be cut out before applying invention.

(63) Parallel aligned next to outside corner eyelid is the fifty-fourth and final positioning of invention. Positions 18, 27, 36, 45, 54 are adjacent with 63. Note: Elements 1,2,3 becomes slightly more elevated towards top of skull than in the fifty-third position thus elevating to the furthest degree of the invention. For one to achieve fifty-fourth positioning, 10 through 54 positioning grids must be cut out before applying invention.

In FIG. 1, element 2, is the base of the invention its function is to aid in giving support and keep the invention properly positioned while user applies invention to face. In FIG. 1, element 3, is the sideburn pattern design and is the third and last part to be pressed against users face.

The grid element 1 has a plurality of horizontal and vertical grid lines arranged in a grid pattern on the front surface and a light tack adhesive on the back surface which is covered with peelable paper. The base member 2 is affixed to one side edge of the grid element in such a manner that the top edges of the base member and the grid element are contiguous. The sideburn pattern design element 3 has a top edge connected to the bottom edge of the base member and a side edge contiguous with the side edge of the base member opposite the grid member and extends downwardly from said base member.

I claim:

1. A sideburn shaving guide comprising:

separate left and right guide pieces, said right and left guide pieces being formed of paper and being mirror images of each other, side piece consisting of:

a grid element, said grid element having opposing top and bottom edges, opposing side edges, and opposing front and back surfaces; said front surface having a plurality of horizontal and vertical grid lines thereon arranged in a grid pattern; said back surface having a light tack adhesive thereon and a peelable paper covering said adhesive;

a base member having opposing top and bottom edges and opposing side edges; one side edge of the base member being affixed to one side edge of the grid element in such a manner that the top edges of the base member and the grid element are contiguous; and a sideburn pattern design, said sideburn pattern design having a top edge connected to the bottom edge of the base member and a side edge contiguous with the side edge of the base member opposite said one side edge affixed to the grid member, said sideburn pattern design extending downwardly from said base member, wherein, the user peels the paper from the grid element and presses the adhesive side against the face aligning a desired grid line with an outside corner of the eye to achieve a desired fit while keeping the horizontal grid lines parallel to the corner outside eyelid, presses the base member against the face and thereafter presses the sideburn pattern design over the user's sideburns and uses the sideburn pattern design to shave the sideburns.

* * * * *